US005451158A

United States Patent [19]

Lin et al.

[11] Patent Number: 5,451,158

[45] Date of Patent: Sep. 19, 1995

[54] ELECTRICAL CONNECTOR WITH IMPROVED CONNECTOR PIN SUPPORT AND IMPROVED MOUNTING TO A PCB

[75] Inventors: Yuan C. Lin, El Toro; Vincent Chen, Walnut, both of Calif.

[73] Assignee: Foxconn International, Inc., Sunnyvale, Calif.

[21] Appl. No.: 143,852

[22] Filed: Oct. 26, 1993

Related U.S. Application Data

[62] Division of Ser. No. 783,189, Oct. 28, 1991, Pat. No. 5,281,166.

[51] Int. Cl.[6] ..... H01R 9/09

[52] U.S. Cl. ..... 439/79; 439/108

[58] Field of Search ..... 439/59, 62, 65, 78, 439/79, 82, 83, 876, 101, 108

[56] References Cited

U.S. PATENT DOCUMENTS

| | | | |
|---|---|---|---|
| 3,107,965 | 10/1963 | Solorow et al. . | |
| 3,601,762 | 8/1971 | Eshelman | 439/79 |
| 3,772,632 | 11/1973 | Rattcliff et al. . | |
| 4,050,769 | 9/1977 | Ammon | 439/79 |
| 4,410,230 | 10/1983 | SanMiguel . | |
| 4,512,618 | 4/1985 | Kumar . | |
| 4,533,203 | 8/1985 | Feldman et al. | 439/79 |
| 4,583,807 | 4/1986 | Kaufman et al. . | |
| 4,585,295 | 4/1986 | Ackerman . | |
| 4,679,883 | 7/1987 | Assini et al. . | |
| 4,681,389 | 7/1987 | Nakazawa et al. . | |
| 4,721,473 | 1/1988 | DelGuidice . | |
| 4,728,304 | 3/1988 | Fischer . | |
| 4,795,353 | 1/1989 | Baker . | |
| 4,824,398 | 4/1989 | Taylor . | |
| 4,842,552 | 6/1989 | Frantz . | |
| 4,857,017 | 8/1989 | Erik . | |
| 4,865,555 | 9/1989 | Assini et al. . | |
| 4,872,846 | 10/1989 | Clark . | |
| 4,907,987 | 3/1990 | Douty et al. . | |
| 4,911,659 | 3/1990 | Viselli . | |
| 4,938,704 | 7/1990 | Fujiura . | |
| 4,943,244 | 7/1990 | Teck et al. . | |
| 4,955,819 | 9/1990 | Harting et al. | 439/79 |
| 5,037,327 | 8/1991 | Van Woensel . | |
| 5,044,988 | 9/1991 | Hirayama . | |
| 5,346,404 | 9/1994 | Shimida | 439/79 |
| 5,354,207 | 10/1994 | Chikano | 439/79 |

OTHER PUBLICATIONS

Capillo, Surface Mount Technology (1990) Excerpt.

Lau, Surface Joint Reliability (1991), Excerpt.

*Primary Examiner*—David L. Pirlot

*Attorney, Agent, or Firm*—Flehr, Hohbach, Test, Albritton & Herbert

[57] ABSTRACT

A "through-hole mounting" boardlock fixture is adapted to secure an electrical connector to a Printed Circuit Board (PCB) employing a Surface Mounting Technology (SMT) procedure. In one aspect, the boardlock fixture comprises a rim defining an opening therethrough and a solder block dimensioned to be insertable within the opening. Furthermore, a plurality of fingers flexibly mounted to the rim extend, generally, downward therefrom. Each respective finger is dimensioned to support the boardlock when inserted in the opening. SMT is applied to melt the solder block to mount the connector to the PCB. In another aspect of the present invention, an electrical connector including a housing is mounted to a PCB. Further, the housing defines a row of apertures each of which a respective pin contact is positioned therein. Each pin contact includes a downward extension extending along a housing back region which terminates at a corresponding PCB circuit. A spacer, including an engagement region, engages the back region of the housing which collectively define a plurality of extension supports that support the respective downward extensions. A method for mounting an electrical component to a PCB comprises the steps of securing a through-hole mounting fixture to the component and inserting the fixture a mounting aperture defined by the PCB. The next step includes supporting a solder block to the fixture and applying a SMT reflow soldering procedure to melt the solder block and solder the fixture to the PCB.

15 Claims, 3 Drawing Sheets

ELECTRICAL CONNECTOR WITH IMPROVED CONNECTOR PIN SUPPORT AND IMPROVED MOUNTING TO A PCB

This is a division of application Ser. No. 07/783,189 filed Oct. 28, 1991 now U.S. Pat. No. 5,281,166.

BACKGROUND OF THE INVENTION

1. Field of the Invention

The present invention relates to electrical connectors and, more particularly, to electrical connectors mounted to Printed Circuit Boards by boardlocks.

2. Description of the Related Art

Surface Mounting Technology (SMT), as applied to Printed Circuit Board (PCB), is the recent trend for the Assembly Industry. SMT is a technique used for mounting connectors and their corresponding connector pin solder tails (e.g., J or Gull-wing leads) directly to one surface of a PCB. When employing this technology, the PCB requires solder paste printing at the contact regions which the corresponding pin tails of an electrical connector are to seat against. The region to be soldered is exposed to a reflow process such as vapor phase, or convection or radiant infrared (IR) which electrically couples the pin tail to the contact region without the occurrence of solder shorts. This technique is advantageous, not only because SMT offers a high degree of soldering precision when applied to selected areas, but also because the electronic components and connectors may be mounted to both sides of the PCB (dual-sided PCB).

In contrast, the conventional method of coupling connector pin tails to a PCB is by inserting the connector pin tails through an array of apertures provided in the PCB and soldering the pin tails to the opposing surface of the PCB using a process known as wave-soldering. This latter method is conventionally known as "through-hole mounting," which, generally, offers a much better retention capability for the pin tails than SMT can provide.

One problem, however, is that wave-soldering usually may not be employed to a dual-sided PCB which includes surface mounted ICs, or passive and discrete components. The wave-soldering technique could permanently damage these components. Moreover, "through-hole mounting" is space inefficient because this technique occupies space on both surfaces of the PCB. Accordingly, SMT often is preferable. An additional problem associated with wave-soldering is that the holes in the second side of the PCB for holding the second side components are filled with solder when the components on the first side of the PCB are soldered. The solder in the second side PCB holes prevents insertion of the second side component legs into the holes.

In many instances, when the pin tails are all housed in one electrical connector, it is desirable to secure the electrical connector itself to the PCB employing SMT.

Often, the adhesion of the connector pin tails to the PCB surface is sufficient to retain connector or component to the surface without additional supplements. This can be most beneficial because, generally, this eliminates the need to attach the connector to the PCB using a separate process.

However, electrical connectors can be exposed to significant mechanical stress. Securing only the pin tails of the connector to the PCB often does not always adequately secure the connector to the PCB. For example, an Input/Output (I/O) connector typically endures a greater number of connector insertions or withdrawals of the corresponding mating connectors. In particular, an I/O electrical connector, such as a D-Subminiature Connector (named for its "D" shape in cross-section), can require additional mounting fixtures. In these instances, it may be desirable to employ a "through-hole mounting" fixture, which typically precludes usage of dual-sided PCBs.

For example, "boardlocks" are one kind of additional mounting support which provide a means for removably mounting the electrical connector to a first PCB surface. Unfortunately, under current practices, SMT generally cannot be applied to boardlocks because the amount of solder predisposed on the PCB surface during the solder paste printing manufacture stage is insufficient to properly retain the boardlock to the opposing second PCB surface. Substantially more solder generally is required to retain the "boardlock" than to retain the contact tail pins.

Therefore, "boardlocks" are typically mounted to the PCB surface using soldering processes other than SMT such as a wave-soldering process. However, as previously mentioned, a wave-soldering process can preclude certain combinations of dual-sided PCB component mountings, such as surface mounted ICs, or passive and discrete components, for example.

Another problem often encountered when applying SMT is that the solder pin tails sometimes can be slightly misaligned from the corresponding printed circuit. Proper placement is, of course, essential to the functioning of the electrical connector. Thus, it is desirable that the tails be properly aligned with the PCB to assure proper contact with the corresponding printed circuit.

Accordingly, there has been a need for an electrical connector which can be more securely mounted to a PCB using SMT. There has also been a need to provide an electrical connector which more precisely aligns the conductive tails against the surface mounted circuits of the PCB. The present invention meets these needs.

SUMMARY OF THE INVENTION

In one aspect, the present invention includes a boardlock device for securing an electrical connector to a Printed Circuit Board (PCB). Briefly, the boardlock comprises a rim defining an opening therethrough and a solder block dimensioned to be insertable within the opening. Furthermore, a plurality of fingers flexibly mounted to the rim extend, generally, downward therefrom. Each respective finger is inclined inward such that the solder block is supported by the plurality of fingers when inserted in the opening.

In another aspect of the present invention, an electrical connector includes an elongated insulative housing including a top surface, a bottom surface, a front region and a back region. Further, the housing defines a first row of first apertures in which a plurality of first pin contacts each including a first insert section is respectively inserted. Each first pin contact includes a first downward extension extending along the back region from a respective first insert section toward the bottom surface. Furthermore, each includes a first surface contact section extending from a respective first downward extension. The electrical connector of the present invention additionally comprises an elongated insulative spacer including an engagement region disposed in engagement with the back surface of the elongated housing. The back region and the engagement region together define a plurality of extension supports that support the respective first downward extensions.

In still another aspect of the present invention, a method is provided for mounting a component to a Printed Circuit Board (PCB) including a first surface, an opposing second surface and defining an aperture extending therethrough. The method comprises the steps of securing a through-hole mounting fixture to the component and inserting the fixture into the aperture from the first PCB surface through the aperture to the second PCB surface. Furthermore, the method includes the step of providing a solder block sized to be supported by the fixture proximate the first PCB surface. The solder block is inserted or placed on the fixture, and then a reflow soldering procedure is applied to melt the solder block which solders the fixture to the PCB.

Thus, the present invention permits through-hole mounting fixtures to be mounted to a PCB using SMT. Further, the present invention permits the connector pin tails to be more precisely aligned against the corresponding circuit contacts when employing SMT.

These and other features and advantages of the present invention will become more apparent from the following description of exemplary embodiment thereof, as illustrated in the accompanying drawings.

BRIEF DESCRIPTION OF THE DRAWINGS

The purpose and advantages of the present invention will be apparent to those skilled in the art from the following detailed description in conjunction with the appended drawings in which.

DETAILED DESCRIPTION OF THE PREFERRED EMBODIMENT

The present invention comprises a novel device which permits "through-hole mounting" fixtures to be mounted to Printed Circuit Boards (PCBs) using Surface Mounting Technology (SMT). The following description is presented to enable any person skilled in the art to make and use the invention, and is provided in the context of a particular application and its requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded with the widest scope consistent with the principles and features disclosed herein.

Figure 1:
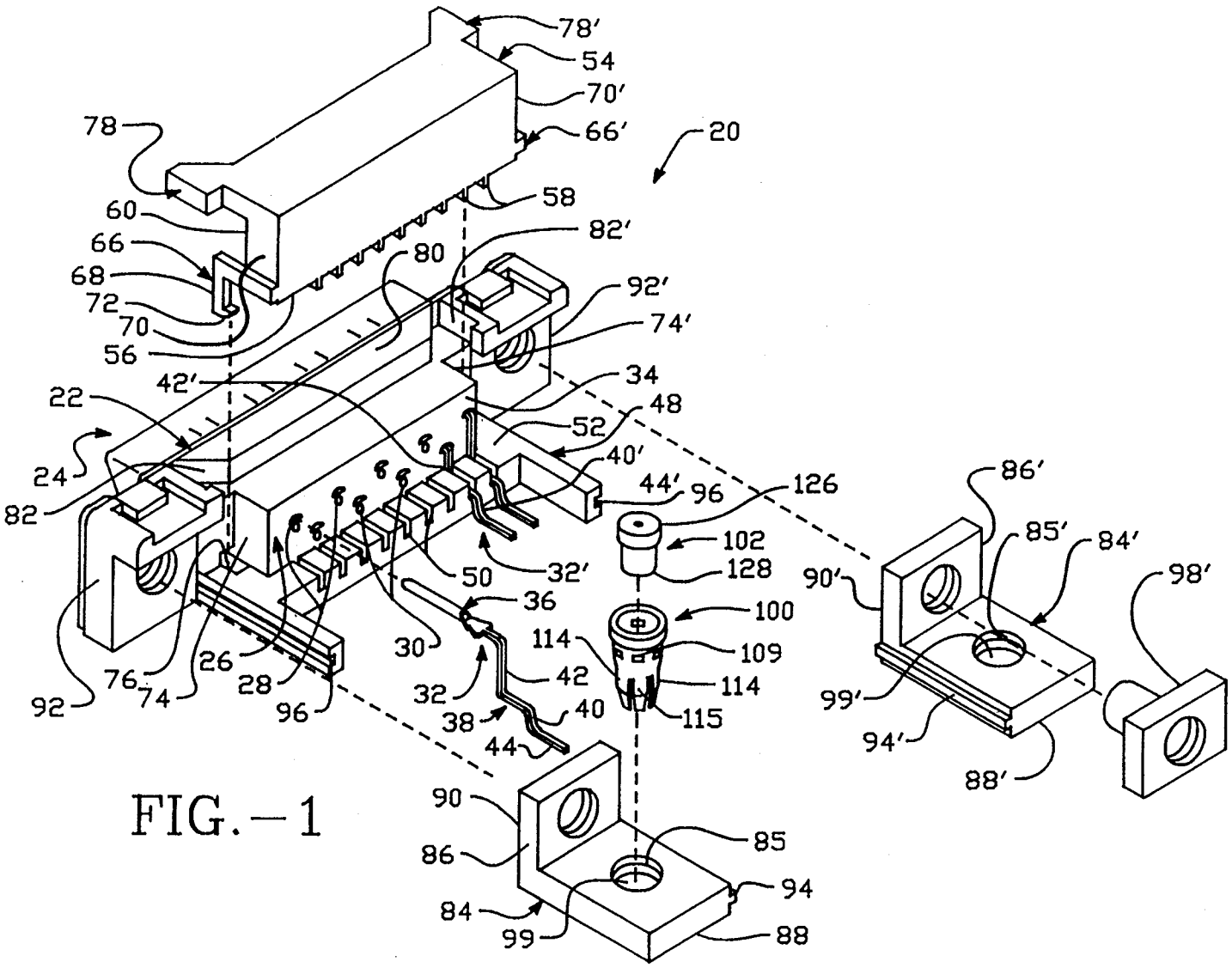
FIG. 1 is a top perspective partially exploded view of a presently-preferred embodiment of an electrical connector assembly in accordance with the present invention.

It will be noted here that for a better understanding, like components are designated by like reference numerals throughout the various figures. Attention is now directed to FIG. 1, where a typical Input/Output (I/O) D-Subminiature Electrical Connector Assembly, generally designated 20, is shown prior to mounting to a printed circuit board (PCB) (not shown) employing Surface Mounting Technology (SMT). Although the present invention is employed specifically with D-Sub Connectors, it will be apparent that any connector may be used in conjunction with the present invention which employs "through-hole mounting" fixture technology.

Briefly, as described in J. Lau, *Solder Joint Reliability,* chaps. 3–4 (1991); C. Capillo, *Surface Mount Technology,* chap. 7 (1990), which are expressly incorporated herein by this reference, SMT is a manufacturing technique employed for mounting connectors and their corresponding connector pin solder tails (e.g., J or Gullwing leads) directly to one surface of a PCB. This technique is advantageous, not only because SMT offers a high degree of soldering precision when applied to selected areas, but also because the electronic components, such as surface mounted ICs or passive and discrete components, and electrical connectors may be mounted to both sides of the PCB (dual-sided PCB).

Briefly, as viewed in FIG. 1, there is shown the connector 20 in accordance with the present invention which comprises an elongated insulative housing 22 including a front region 24, and a rear region 26 which defines a substantially planar rear vertical face 34. Insulative housing 22, further, defines an first row of upper apertures 28 and a second row of lower apertures 30, both of which extend from the front region 24 to the rear region 26 of housing 22. As will be discussed in greater detail below and as illustrated in FIG. 1, the individual upper apertures 28 preferably do not lie in the same vertical plane as any individual lower aperture 30.

Figure 2:
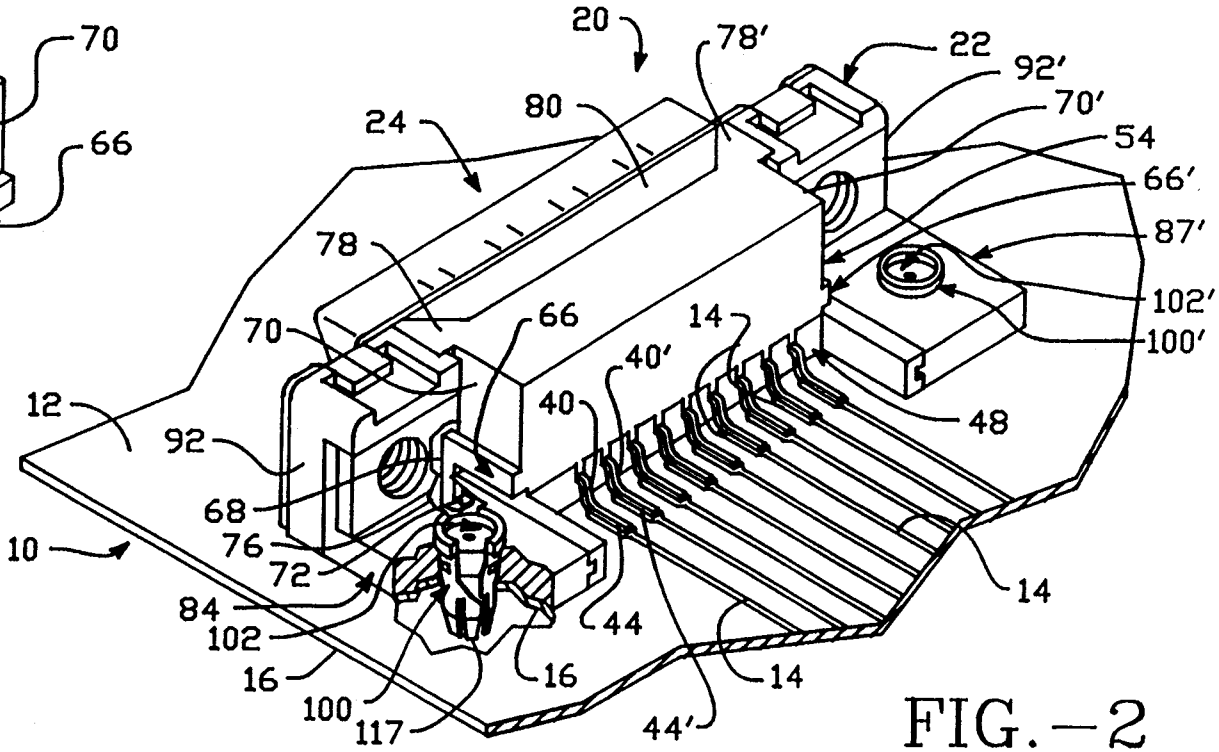
FIG. 2 is an enlarged partially cutaway top perspective view of an assembled electrical connector of FIG. 1 illustrating the conductive member tails securely retained and mounted to a Printed Circuit Board.

Each upper aperture 28 is dimensioned to receive a respective first upper pin contact 32 which permits electrical communication therethrough. Similarly, each lower apertures 30 is dimensioned to receive a respective lower pin contact 32'. Each respective upper and lower pin contact 32 and 32' comprises a respective elongated insert section 36 (36' now shown for pin contact 32') and a respective conductive tail portion 38 and 38' extending therefrom. As shown in FIG. 2, the tail portions 38, 38' terminate flush against and co-planar to a first surface 12 of a PCB 10. Each respective tail portion 38 and 38' comprises an elongated downward extension 42 and 42' inclined downward from and substantially perpendicular to the respective insert section 36 and 36'. It will be appreciated that the respective downward extension 42 of pin contact 32 is longer than the respective downward extension 42' of pin contact 32' to compensate for the vertical height difference between the upper row apertures 28 and lower row apertures 30 with respect to the first PCB surface 12.

As will be described in greater detail below, each respective tail portion 38 and 38' of respective pin contact 32 and 32' includes a PCB surface contact section 44 and 44' extending rearward from and substantially perpendicular to the respective lower distal end of the respective downward extensions 42 and 42'. An oblique section 40 and 40' positioned between the respective downward extension 42 and 42' and the respective surface contact section 44 and 44' permits the respective contact section 44 and 44' to seat flush against the corresponding circuit contacts 14. Accordingly, as shown in FIG. 2, respective extensions 42 and 42', in combination with respective oblique section 40 and 40' reposition the respective surface contact section 44 and 44' to be co-planar with the first PCB surface 12.

Employing SMT, each tail portion 38 and 38' is dimensioned to adjacently seat against the a corresponding printed circuit contact 14 in an aligned precise manner such that proper electrical contact is made. This may best be viewed in FIG. 2 which illustrates the presently preferred connector assembly 20 mounted to the first surface 12 of the PCB 10.

Referring back to FIG. 1, connector assembly 20 includes an alignment flange 48 extending rearward from and substantially perpendicular to the rear vertical face 34 of rear region 26. Alignment flange 48 defines a plurality of vertical alignment channels 50 extending downward from a top surface 52 of flange 48. Channels 50 are axially aligned parallel to the upper and lower apertures 28 and 30, respectively, with each being dimensioned to receive and align a respective portion of the tail portion 38 and 38' of pin contacts 32 and 32'. It will be appreciated that, in the preferred form, each alignment channel 50 corresponds to, and is positioned in the same vertical planes (not shown) which axially intersect respective apertures 28 and 30. Accordingly, as shown in FIG. 2, when the pin contacts 32 and 32' are positioned in the respective corresponding apertures 28 and 30, the respective tail portions 38 and 38' are precisely aligned to engage the corresponding printed circuit contacts 14.

An alignment spacer 54 is positioned rearward of housing 22 which is dimensioned to engage the rear region 26 of housing 22 such that each downward extension portion 42 and 42' of respective pin contacts 32 and 32' is insulated from each other and from exposure to the environment. More importantly, a bottom surface 56 of spacer 54 includes a plurality of downwardly extending alignment ribs 58 correspondingly positioned and dimensioned to insert into respective alignment channels 50 when spacer 54 mountingly engages housing 22.

As best viewed in FIG. 2, the respective alignment ribs 58 extend into the respective alignment channels 50 until the respective distal end portions abut the respective tail portions 38 and 38'. This wedges the respective tail portions 38 and 38' between the base of the respective channels 50 and the respective distal ends of the alignment ribs 58, urging the respective surface contact sections 44 and 44' against the corresponding circuit contacts 14. Further, the respective channels 50 and corresponding alignment ribs 58 provide lateral support to tail portions 38 and 38'. This affords a higher degree of control of the surface contact sections 44 and 44' which results in more placement precision and easier control upon engagement with the corresponding circuit contacts 14.

The insulative housing 22, the alignment flange 48 and the spacer 54 enclose each tail contact portions 38, 38', except for their respective oblique section 40, 40' and respective surface contact section 44, 44'. Together, the alignment flange 48 and the spacer 54 provide additional extension support to the respective downward extension portions 42 and 42' much closer to the contact region, and hence, tail contacts portion 38, 38' during insertion and removal of a mating electrical connector. Since only the respective oblique section 40, 40' and respective surface contact section 44, 44' extend unsupported from the flange/spacer assembly, the bending moment acting about the protruding tail portions 38 and 38' created when a mating connector (not shown) is installed or removed to the connector assembly 20, is much smaller.

Figure 3:
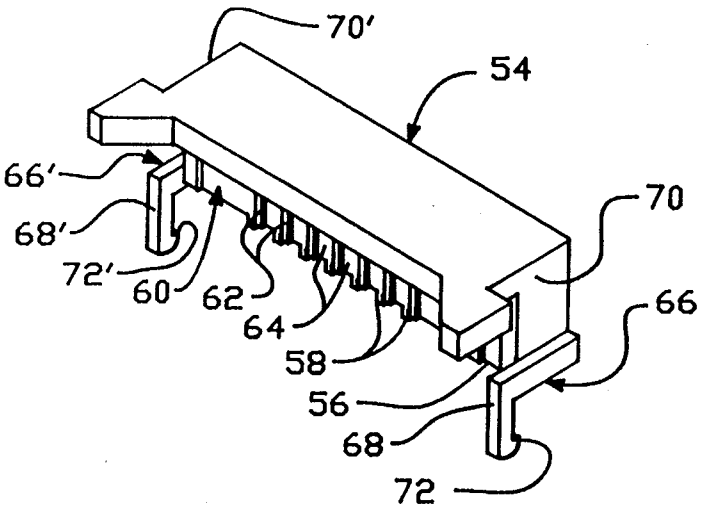
FIG. 3 is an enlarged front perspective view the alignment spacer of the electrical connector of FIG. 1.

Referring now to FIG. 3, the alignment spacer 54 includes a front face 60 which is formed to be seated against the rear face 34 of housing 22. Protruding outward substantially perpendicularly from the front spacer face 60 in a direction toward the rear housing face 34 is a plurality of stand-off ribs 62 formed to abut the rear housing face 22. Stand-off ribs 62 are dimensioned to off-set the front spacer face 60 from the rear housing face 34 by a distance equivalent to the depth of the stand-off rib 62. In combination, the adjacent stand-off ribs 62 define stand-off channels 64 therebetween which provide a aperture for the corresponding elongated downward extensions 42 and 42' of respective tail portions 38 and 38'. As viewed in FIG. 3, the stand-off ribs 62 are positioned perpendicular to the alignment ribs 58. Moreover, the stand-off ribs 62 are, further, positioned in a staggered relationship with the alignment ribs 58 so that the stand-off channels 64 correspond therewith. Accordingly, when the spacer 54 engages the housing 22, the respective downward extension portions 42 and 42' are received in the corresponding stand-off channels 64 and are insulated from one another.

The alignment spacer 54 further includes a first and a second hook latch 66 and 66' positioned on the opposite ends of the spacer 54 wherein both the alignment ribs 58 and the stand-off ribs 62 are situated therebetween. Each hook latch 66 and 66' includes a respective L-shaped extension member 68 and 68' integrally coupled to a first spacer side portion 70 and an oppositely facing second spacer side portion 70' of spacer 54, respectively. The respective downwardly extending distal end of latch extension members 68 and 68' each protrude from spacer 54 in a direction toward the upper surface 52 of alignment flange 48, as viewed in FIG. 1. Additionally, each latch extension member 68 and 68' includes a respective hook portions 72 and 72' extending rearward in a direction substantially parallel to the upper and lower apertures 28 and 30. The hook latches 66 and 66' provide a means for removably securing the alignment spacer 54 to the housing 22.

Defined between a respective first housing side portion 74 and a respective oppositely facing second housing side portion 74' of housing 22, and the alignment flange 48, as shown in FIG. 1, are a respective first and a respective second (not shown) hook apertures 76 and 76' positioned opposite the respective hook latches 66 and 66' when spacer 54 engages housing 22. Each aperture 76 and 76' is dimensioned to cooperate and receive the respective hook portions 72 and 72' for removable securement. This concept is best viewed in FIG. 2, which illustrates hook portion 72 engaging a ledge portion of hook aperture 76.

Positioned proximate the each upper portion of respective opposing first and second spacer side portions 70 and 70' is a respective first and second alignment wing 78 and 78' protruding respectively forward from the spacer 54. A top surface 80 of housing 22 defines a first and a second wing recess 82 and 82' respectively positioned opposite wings 78 and 78' to matingly engage the respective alignment wings 78 and 78'. Therefore, the respective first and second recesses 82 and 82' are dimensioned for receipt of respective wings 78 and 78'. Accordingly, when alignment spacer 54 engages housing 22, which precisely positions the surface contact sections 44 and 44' against the corresponding circuit contacts 14, the respective latch hooks 68 and 68' retainably engage the respective hook apertures 76 and 76', while the respective wings 78 and 78' alignably engage the respective recesses 82 and 82' to properly seat the spacer 54 against the housing 22.

In another aspect, the present invention provides a means for mounting "through-hole mounting" fixtures to a PCB using Surface Mounting Technology (SMT). In particular, the connector assembly 20 may be mounted, via boardlocks, to the first surface 12 of PCB 10 by employing an SMT procedure in which the surface contact sections 44 and 44' are electrically coupled to the corresponding circuits 14, simultaneously. In brief, SMT, as mentioned previously, is a technique used for mounting connectors and their corresponding connector pin solder tails (e.g., J or Gull-wing leads) directly to one surface of a PCB.

During manufacture, the PCB 10 requires solder paste printing at the contact circuit regions 14 which the corresponding surface contact sections 44 and 44' are to seat against. The contact sections 44 and 44' are placed in physical contact with the circuit regions 14. The selected members to be soldered together then are exposed to a reflow process such as vapor phase, or convection or radiant infrared (IR) which transforms the solder to a molten state. When the solder later solidifies again, it electrically couples the contact sections 44 and 44' to the circuits 14. It will be appreciated that SMT procedures are well known in the art and will be understood without the need for additional explanation herein.

In the preferred embodiment, boardlocks are employed as the "through-hole mounting" fixture of choice. However, it will be apparent that the present invention may apply to other "through-hole mounting" fixtures as well, such as metal hold-downs, for example, Hirayama et al. (U.S. Pat. No. 5,044,988). In a present embodiment, the boardlock includes resilient downwardly extending prongs which are inserted through a respective corresponding aperture in the PCB surface. Subsequently, the prongs are soldered to the PCB surface opposite the surface on which the electrical connector is mounted.

Briefly, as best viewed in FIG. 2, a first and a second boardlock 100 and 100' extend through a respective first and second L-shaped bracket 84 and 84', and further, through a respective corresponding connector aperture (not shown) defined through the PCB 10. This configuration, as just described, is the position necessary just before solder mounting the boardlock to the PCB surface. As shown, the boardlock is "through-hole mounting" device used to mount an electrical connector to a PCB.

Figure 4:
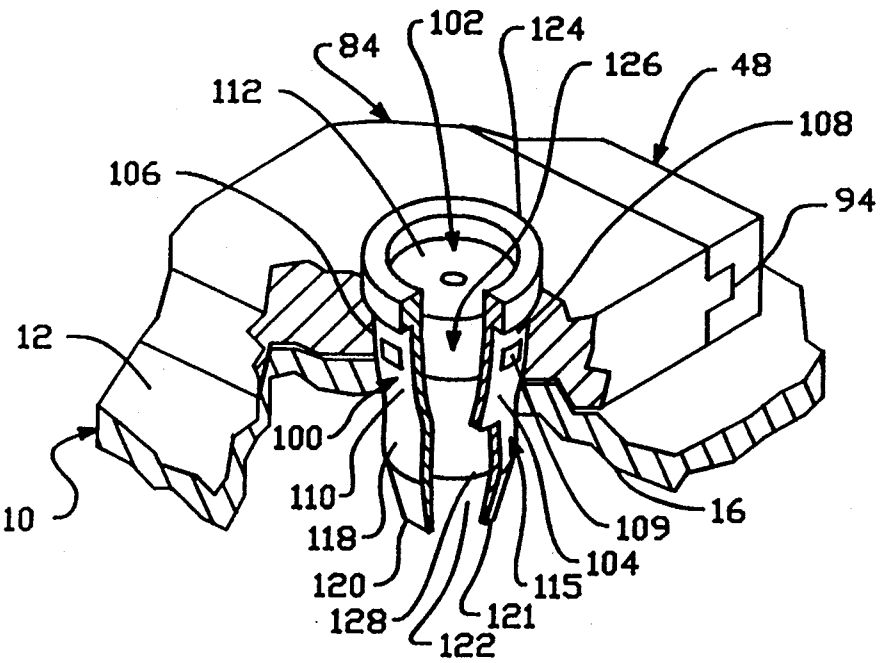
FIG. 4 is an enlarged cutaway top perspective view of a boardlock housing a solder block in accordance with the present invention before surface mounting technology (SMT) has been applied.

In accordance with the present invention, a solder block 102 and 102', as shown in FIG. 1, is positioned centrally within the respective boardlocks 100 and 100' and seated in a position more clearly illustrated in FIG. 4. The solder blocks 102 and 102' are essentially preshaped solder pieces dimensioned to insert into the cavity of the boardlock. It will be appreciated that, in the preferred embodiment, solder block 102 and 102' is inserted into respective boardlocks 100 and 100'. However, solder blocks 102 and 102' may just as easily be enclosed, mounted, clipped, adhesively coupled, or the like, to either the interior or exterior portions of boardlocks 100 and 100' without departing from the true spirit and scope of the present invention.

Figure 5:
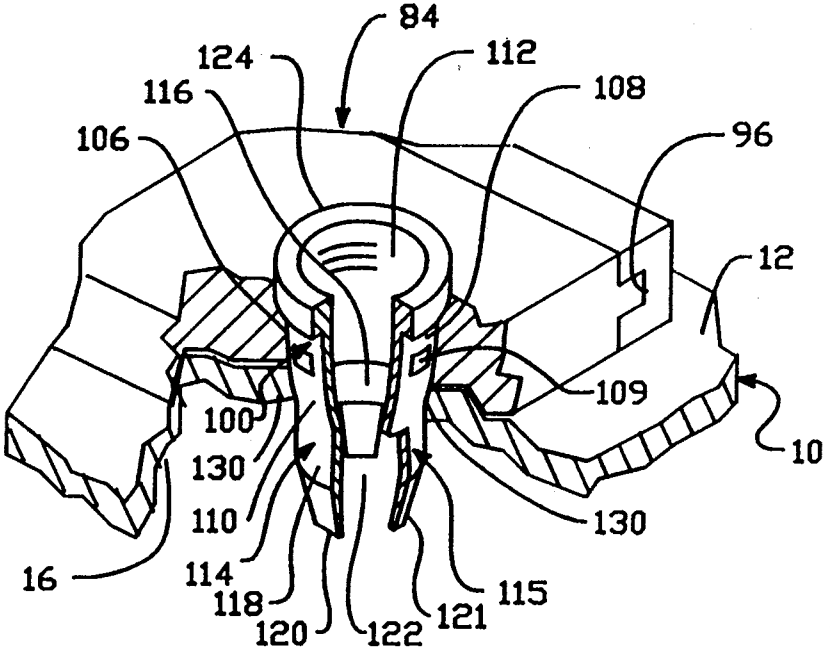
FIG. 5 is a cutaway perspective top view of a boardlock assembly of FIG. 4 after SMT has been applied.

A reflow soldering process (i.e., IR or Vapor Phase (not shown)) will be applied to the first surface 12 region occupied by the connector assembly 20 on the PCB 10. In accordance with the present invention, the reflow soldering process will simultaneously melt the pre-printed solder paste at the circuits contacts 14 thereby electrically coupling the corresponding surface contact sections 44 and 44' thereto, while, further, melting the solder blocks 102 and 102' to securely mount the respective boardlocks 100 and 100' to the opposing second PCB surface 16. FIG. 5 illustrates the melted solder 104, which composes the solder block 102, after the reflow soldering process which has been repositioned to securely retain the boardlock 100 to the PCB. The connector assembly boardlocks and the electrical pin tails may be mounted to the PCB, simultaneously, using SMT. Therefore, the greater retention capabilities offered from "through-hole mounting" fixtures may be used in conjunction with the SMT process.

As previously mentioned, through-hole mounting fixtures, typically, are not mounted to PCBs using an SMT process because the amount of solder predisposed on the PCB surface during the solder paste printing manufacture stage typically is insufficient to properly retain the fixture to the opposing second PCB surface.

Thus, an alternate soldering process such as wave-soldering generally is used to mount through-hole mounting fixtures. One reason that such alternate soldering processes are used is that a greater quantity of molten solder is available to secure the fixture to the PCB. However, as stated, a wave-soldering process can preclude certain combinations of dual-sided PCB component mountings, such as surface mounted ICs, or passive and discrete components, for example. Accordingly, the present invention permits mounting a through-hole fixture to a PCB using an SMT procedure.

Henceforth, the PCB mounting structure will be described in greater detail. Referring back to FIG. 1, there is shown a first and a second L-shaped mounting bracket 84 and 84' positioned on opposing adjacent sides of flange 48. Each L-shaped bracket 84 and 84' includes an upstanding housing mounting portion 86 and 86' and a respective PCB mounting portion 88 and 88'. Housing mounting portions 86 and 86' each include a front face 90 and 90' dimensioned to mount flush against a respective first and second housing ear portion 92 and 92' protruding laterally outward from and substantially perpendicular to the respective opposing first and second housing side portions 74 and 74'. A respective first cinch nut (not shown) and a second cinch nut 98' are positioned rearward of the respective housing mounting portion 86 and 86'. FIGS. 1 and 2 illustrate that the respective housing mounting portion 86 and 86' is positioned between the respective first and second cinch nut 98 and 98'; and the respective first and second housing mounting ears 92 and 92' such that the first and second L-shaped bracket 84 and 84' is mounted to housing 22.

Positioned on each respective inner wall of lower PCB mounting portion 88 and 88' respectively facing in a direction toward the flange 48 is a respective male bracket alignment guide 94 and 94'. As best viewed in FIG. 1, the flange 48 includes corresponding respective mating female alignment guide 96 and 96' dimensioned to slidably receive the respective male bracket guide 94 and 94'. Thus, it will be appreciated that when each L-shaped bracket 84 and 84' is coupled to the respective housing ears 92 and 92' of housing 22, the respective front face 90 and 90' of housing mounting portions 86 and 86' mounts flush against the respective ears 92 and 92', as illustrated in FIG. 2. Moreover, the respective male bracket alignment guide 94 and 94' cooperates and alignably engages the respective female mating alignment guide 96 and 96' to properly position the respective L-shaped bracket 84 and 84' against the housing 22.

In the preferred form, each L-shaped bracket 84 and 84' is preferably metal. In some instances, an insulative material may be sufficient to retain the boardlock which is generally metallic. This mounting structure is broadly known and does not constitute a novel aspect of the present invention.

Each PCB mounting portion 88 and 88' defines a boardlock support aperture 99 and 99' extending therethrough. Further, each aperture 99 and 99' includes a countersunk upper portion 85 and 85' dimensioned to retain and support the corresponding boardlocks 100 and 100', as will be described in more detail below. However, the depth of the respective countersunk 85 and 85' is sufficient to position the respective boardlock 100 and 100' flush with the top surface of the PCB mounting portion 88 and 88'.

The boardlock 100, as shown in FIG. 5 and in accordance with the present invention, will be described herein. It will be appreciated that for the ease of description, only one boardlock will be described henceforth; however, each boardlock 100 and 100' is similarly structured. In general, the boardlock 100 comprises a hollow, substantially cylindrical rim portion 104 defining an outer periphery 106 and including a top portion 108 and a bottom portion 110. The boardlock 100 has a plurality of orifices 109 on the top portion 108 in interference engagement with the boardlock support aperture 99 of the L-shaped bracket 84.

The top portion 108 of the rim 104 includes a first opening 112 defining a first cross-sectional area. Extending downward from the bottom portion 110 of the rim portion 104 is a plurality of equally spaced fingers 114, 115 radially positioned about the cylindrical rim axis. Collectively, fingers 114, 115 define a cavity 116 therebetween.

As illustrated in FIGS. 4 and 5, boardlock 100 has two sets of fingers, resilient fingers 114 and support fingers 115, which are alternately displaced on bottom portion 110. Each resilient finger 114 includes a respective stop member 118 inclined outward from the bottom portion 110 of the rim 104 in a direction diverging away from the cylindrical axis. Coupled to each diverging distal end of the stop member 118 is a respective guide member 120 inclined inward converging toward the cylindrical axis. Each support finger 115 is L-shaped extending downward from the bottom portion 110 parallel to the cylindrical axis of boardlock 100. Support member 121 at the distal end of finger 115 protrudes inward, perpendicular to the cylindrical axis.

It will be appreciated that the respective distal ends of the guide members 120 and support members 121 collectively terminate at a second opening 122 which defines a second cross-sectional area smaller than the first cross-sectional area 112 defined by the rim 104. Furthermore, the preferred embodiment of boardlock 100 has six fingers, three of resilient fingers 114 and three of support fingers 115. However, any number of fingers either exclusively resilient fingers 114, exclusively support fingers 115, a combination of fingers 114 and 115, or a combination of other finger types may be used without parting from the spirit or scope of the invention.

Extending radially outward from the outer periphery 106 proximate the top portion 108 is a circumferential lip portion 124 dimensioned to retain the boardlock 100 in the corresponding boardlock aperture 99. It will be noted that the corresponding boardlock aperture 99 is dimensioned to receive the outer periphery 106 of the rim 104, while the countersunk portion 85 is dimensioned to receive the circumferential lip portion 124. Accordingly, during insertion of the boardlock 100 into the corresponding boardlock aperture 99 of the PCB mounting portion 84, the respective resilient fingers 114 are deflected inwardly toward the cylindrical axis as they engage the boardlock aperture 99 walls until they pass therethrough.

Once boardlock 100 is set in boardlock aperture 99, connector assembly 20 is ready for attachment to PCB 10. The respective resilient fingers 114 pass through the corresponding PCB aperture ((not shown) defined by the PCB) until the lower portion 88 of L-bracket 84 engages first PCB surface 12. Subsequently, the respective resilient fingers 114 are resiliently urged outward to a substantially unbiased position wherein the respective stop members 118 extend beyond the PCB aperture periphery to engage the opposing second PCB surface 16.

Once this structural configuration is established, the solder block 102 may be inserted into the first opening 112 of boardlock 100. Alternately, solder block 102 may be inserted into boardlock 100 prior to insertion of boardlock 100 into PCB 10 or boardlock aperture 99.

As best viewed in FIG. 1, the solder block 102 preferably includes a substantially solid upper body portion 126 circumferentially dimensioned substantially similar to the first opening cross-sectional area 112 of the rim portion 104. Additionally, the solder block 102 includes a substantially solid lower body portion 128 circumferentially smaller than the upper body portion 126, but dimensioned circumferentially larger than the second opening cross-sectional area 122. Accordingly, when the solder block 102 is inserted into the first opening 112, the lower body portion 128 will travel through finger cavity 116 until it seats against support members 121 of fingers 115 which retain and support the solder block 102 therein.

The solder block 102 provides the boardlock 100 with a sufficient amount of solder to retain the respective fingers 114, 115 to the second PCB surface 16. As mentioned, preprinted solder paste, applied during normal SMT procedures, is insufficient to properly retain a boardlock to a PCB. As will be described below, during the SMT reflow process, the solder block 102 is melted which retainably couples the electrical connector 20 to the PCB 10. Hence, dual-sided PCBs, including surface mounted ICs, or passive and discrete components may be employed.

It will be appreciated that the solder block 102 may be manufactured to any specification (i.e., melting temperature, composite, etc.) suitable for a particular application. Moreover, although the preferred upper body portion 126 is circumferentially similar to the first opening cross-sectional area 112, the most important dimension is that the lower body portion 128 be large enough so as not to slip through the second opening 122. However, more contact with the boardlock rim portion 104 is preferable because this assures better conductivity during the reflow soldering process.

Referring now to FIG. 4, the boardlock 100 is represented housing a solder block 102 before the reflow process. Incidently, IR is the preferred method of reflow soldering because the process is more area specific, and thus, more controllable. It will be appreciated, however, that vapor phase reflow soldering may be applied.

During the reflow soldering process, the solder block 102 is melted and the melted solder 130 is drawn through gaps 117 (FIG. 2), formed between the adjacent fingers 114,115, by soldering. Accordingly, the melted solder 130 repositions between the respective fingers 114,115 and the second PCB surface 16 forming a fillet, as shown in FIG. 5, which securely retains the boardlock 100 to the PCB 10. Additionally, top portion 108 of boardlock 100 may have orifices 109 through which melted solder is drawn. The melted solder 130 drawn through orifices 109 helps secure boardlock 100 to L-bracket 84.

It will be appreciated that the present invention permits similar connector couplings to dual-sided PCBs wherein the connector assembly 20 is mounted to the opposing second PCB surface 16 while the corresponding boardlocks 100 and 100' are mounted to the first PCB surface 12.

In still another aspect of the present invention, a method of mounting an electrical connector 20 to a Printed Circuit Board (PCB) 10 comprising the steps of securing a "through-hole mounting" fixture to the electrical connector 20. In the preferred embodiment, the fixture comprises the boardlock 100, 100' set forth above. The next step includes inserting the boardlock 100 into the PCB aperture (not shown) from the first PCB surface 12 through the aperture to the second PCB surface 14. Furthermore, the method includes supporting the solder block 102, 102' on the boardlock 100. The solder block 102, 102' is dimensioned to be supported within the boardlock 100 proximate the first PCB surface 12 which the connector 20 rests on. Next, a Surface Mounting Technology (SMT) reflow soldering procedure is applied to melt the solder block 102,102' and couple the boardlock 100 to the second PCB surface 16. The same reflow procedure is used to solder the contact sections 44, 44' to the circuit contacts 14. Thus, only a one step SMT process is necessary, since soldering of boardlocks 100 and contacts 14 is performed simultaneously by the same reflow procedure.

It will be appreciated that the solder block 102,102' may be just as easily be enclosed, mounted, clipped, adhesively coupled, or the like, to a "through-hole mounting" fixture without departing from the true spirit and scope of the present invention. However, the preferred method of securement to the boardlocks 100 and 100', in particular, is to insert them into the respective opening 112, 112' until the solder block 102, 102 seats against the respective guide members 120, 120'.

While the present invention has been described with reference to a few specific embodiments, the description is illustrative of the invention and is not to be construed as limiting the invention. Various modifications to the present invention can be made to the preferred embodiments by those skilled in the art without departing from the true spirit and scope of the invention as defined by the appended claims.

Therefore, persons of ordinary skill in this field are to understand that all such equivalent structures are to be included within the scope of the following claims:

What is claimed is:

1. An electrical connector formed for mounting to a mounting surface of a Printed Circuit Board (PCB), the connector comprising:

an elongated insulative housing having a front region and a back region, said housing defining a plurality of apertures extending therethrough from said back region to said front region;

a plurality of pin contacts each including an insert section formed for sliding receipt in a respective aperture, a downward extension portion extending downwardly from said insert section toward the PCB mounting surface, and a resilient tail portion extending away from said downward extension in a direction generally parallel to said mounting surface, said tail portion having a surface contact section formed for electrical contact with a respective circuit contact on the mounting surface; and an elongated insulative spacer releasably mounted proximate to said back region of said housing, and including an engagement region engaging a topside of the resilient pin tail portions in a manner urging the contact sections into abutting contact with the respective circuit contacts when said connector is mounted to said PCB.

2. The electrical connector as defined in claim 1 wherein, each pin contact extension portion extends downwardly along said back portion.

3. The electrical connector as defined in claim 1 wherein, said back region includes a rearwardly extending flange portion defining a plurality of channels each formed for sliding receipt of a respective tail portion therein.

4. The electrical connector as defined in claim 3 wherein, said spacer provides a plurality of alignment ribs each aligned for sliding mating engagement with a respective channel, and formed to abut the topside of a respective tail portion to urge said contact portion into electrical contact with the respective circuit contact.

5. The electrical connector as defined in claim 1 wherein, said apertures are aligned in a first row.

6. The electrical connector as defined in claim 5 further including:

a second row of a plurality of second apertures extending through said housing from said back region to said front region; and a plurality of second pin contacts each including an insert section formed for sliding receipt in a respective second aperture, a downward extension portion extending downwardly from said insert section toward the PCB mounting surface, and a resilient tail portion extending away from said downward extension in a direction generally parallel to said mounting surface, said tail portion having a surface contact section formed for electrical contact with a respective circuit contact on the mounting surface.

7. The electrical connector as defined in claim 6 wherein, each the first named apertures and the second apertures are aligned in the same respective vertical plane.

8. The electrical connector as defined in claim 1 wherein, said back region and said engagement region together define a plurality of stand-off channels formed for receipt of a respective pin contact downward extension.

9. The electrical connector as defined in claim 8 wherein, said stand-off channels are provided by a plurality of stand-off ribs protruding outwardly from said engagement region in a direction toward said back region.

10. The electrical connector as defined in claim 1 further includes:

a locking mechanism coupled between one of said spacer and said housing to releasably lock said spacer to said housing.

11. The electrical connector as defined in claim 10 wherein, said locking mechanism comprises a pair of locking hooks extending downwardly from opposite ends of said spacer.

12. The electrical connector as defined in claim 11 wherein, said housing defines a pair of locking slots aligned with and dimensioned to receive said locking hooks therein for engagement with said housing to securably retain said spacer to said housing.

13. The electrical connector as defined in claim 12 wherein, said housing includes mounting means for mounting the connector to the mounting surface of the PCB.

14. The electrical connector as defined in claim 1 wherein, the contact sections of said plurality of pin contacts engage the respective circuit contacts in a co-planar manner.

15. The electrical connector as defined in claim 14 wherein, said tail portions are positioned substantially co-planar one another proximate said mounting board.

* * * * *